US006508416B1

(12) United States Patent
Mastro et al.

(10) Patent No.: US 6,508,416 B1
(45) Date of Patent: Jan. 21, 2003

(54) COATED FUEL INJECTOR VALVE

(75) Inventors: Noreen Louise Mastro, Rochester, NY (US); Jeffrey Mark Noll, Honeoye Falls, NY (US); David Wesley Rogers, Henrietta, NY (US); Robert Halsall, Washington, MI (US); Stephen Joel Harris, Bloomfield, MI (US); Anita Miriam Weiner, West Bloomfield, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/561,574

(22) Filed: Apr. 28, 2000

(51) Int. Cl.[7] ..... B05B 1/30

(52) U.S. Cl. ..... 239/585.1; 239/533.2; 427/249.7; 427/249.15; 427/490; 427/577

(58) Field of Search ..... 239/533.1–533.12, 239/585.1–585.5, 584, 87–92; 251/129.15, 129.21; 427/249.7, 249.1, 249.15, 249.6, 577, 490, 579, 489; 123/90.51, 90.48, 668; 428/336

(56) References Cited

U.S. PATENT DOCUMENTS 5,012,982 A * 5/1991 Souma et al. ..... 239/585.1
5,048,497 A * 9/1991 Kishida et al. ..... 239/585.1
5,336,320 A * 8/1994 Hogan et al. ..... 239/584
5,391,407 A * 2/1995 Dearnaley ..... 427/527
5,585,176 A * 12/1996 Grab et al. ..... 428/336
5,688,557 A * 11/1997 Lemelson et al. ..... 427/249
5,731,045 A * 3/1998 Dearnaley et al. ..... 427/249
5,783,261 A * 7/1998 Potter et al. ..... 427/526
5,837,357 A * 11/1998 Matsuo et al. ..... 428/212
6,062,498 A * 5/2000 Klopfer ..... 239/553.2
6,145,763 A * 11/2000 Fleming et al. ..... 239/585.1

* cited by examiner

*Primary Examiner*—Michael Mar
*Assistant Examiner*—Dinh Q. Nguyen
(74) *Attorney, Agent, or Firm*—Patrick M. Griffin

(57) ABSTRACT

An electromagnetic fuel injector having improved wear characteristics comprises a body having a fuel inlet and a fuel outlet. A valve seat is sealably connected to the body, and a moveable valve member positioned at the fuel outlet for controlling the flow of fuel from the outlet comprises a valve outlet element that provides a sealing interface with the valve seat. The valve member and included valve outlet element further comprise wear surfaces that are subject to repeated impact and/or sliding contact; at least a portion of these wear surfaces comprise an applied layer of diamond-like carbon (DLC) stabilized by inclusion of greater than 30 weight percent of a carbide-forming material selected from the group consisting of silicon, titanium, and tungsten.

46 Claims, 5 Drawing Sheets

COATED FUEL INJECTOR VALVE

TECHNICAL FIELD

The present invention relates to fuel injectors for delivery of fuel to the intake system of an internal combustion engine and, more particularly, to an electromagnetic fuel injector having improved wear characteristics.

BACKGROUND OF THE INVENTION

Many of the components in a modern, internal combustion engine must be manufactured to precise tolerances in order to optimize fuel economy and engine performance and to minimize vehicle emissions. Yet, those same components are expected to operate in the most harsh environments such as at extreme temperatures and under repeated high loads, without premature failure.

It is known in the art to use coatings of various materials on critical components of internal combustion engines for the purpose of improving wear resistance and/or reducing friction. For example, amorphous hydrogenated carbon films and amorphous or nanocrystalline ceramic coatings applied to powertrain components, in particular valve lifters, are described in U.S. Pat. Nos. 5,237,967, 5,249,554, and 5,309,874, the disclosures of which are incorporated herein by reference. Also, U.S. Pat. No. 5,783,261, the disclosure of which is incorporated herein by reference, describes the use of amorphous carbon-based coating containing up to 30% by weight of a carbide-forming material to extend the operating life of a fuel injector valve having a needle operating within a valve body.

In an internal combustion engine, a fuel injector valve mechanism must provide a controlled amount of fuel to each cylinder synchronously with the cycle of the engine in order to control fuel economy, performance and vehicle emissions. The injector surfaces, which are subject to sliding and/or impact contact with other metal surfaces, are typically lubricated by conventional fuel, such as gasoline, thereby preventing undue wear that reduces the useful life of the injector.

With the worldwide fluctuations in the supply of oil, the market has turned to alternate fuels, such as fuels having alcohol components, as a means for supplementing the oil supply. However, the inclusion of an alcohol such as ethanol in a gasoline fuel can greatly increase the fuel's acidity and reduce its lubricity, resulting in corrosive wear, scuffing, galling, and other damage to both mating parts of sliding and impact surfaces of the fuel injector. The damage can lead to erratic fuel metering by the injector. The magnitude of the effect is dependent on the amount of alcohol added to the fuel and the quality of the alcohol-containing fuel. is Poorer quality ethanol-containing fuels have been found to be contaminated with upwards of 25 ppm sulfuric acid, which greatly exacerbates the above problems and can result in large injector flow shifts (calibration changes) and intermittent valve sticking before the injector reaches even a fraction of its normal life. This, in turn, negatively affects the engine's ability to precisely control the amount of fuel received in the combustion chamber which can adversely impact fuel economy, performance and emissions.

Reducing the wear of an injector valve assembly, especially one to be used with corrosive ethanol-gasoline mixes or other fuels with lubricity-limiting components, for example, low-sulfur diesel fuels, is thus a highly desirable objective, which is realized by the present invention. Also, what is needed in the art is an injector valve assembly with increased reliability of performance with minimal flow shifts due to wear or valve sticking over its useful life.

SUMMARY OF THE INVENTION

The present invention, directed to an electromagnetic fuel injector having improved wear characteristics, comprises a body having a fuel inlet and a fuel outlet. A valve seat is sealably connected to the body, and a moveable valve member positioned at the fuel outlet for controlling the flow of fuel from the outlet. The valve member includes a valve outlet element that provides a sealing interface with the valve seat. The valve member and valve outlet element further comprise wear surfaces that are subject to repeated impact and/or sliding contact. At least a portion of these wear surfaces are coated with a thin layer of diamond-like carbon (DLC) stabilized by inclusion of greater than 30 weight percent of a carbide-forming material selected from the group consisting of silicon, titanium, and tungsten. A solenoid actuator disposed within the body controls the movement of the valve member relative to the valve seat.

It has been found that the quality of the adhesion of the DLC coating can worsen as the coating thickness increases significantly above 6 $\mu$m. This can lead to a loss of adhesion, chipping of the coating, and degradation of the coating's ability to resist metal wear. In another embodiment, a first layer of non-magnetic metal is placed as a foundation below the DLC layer in the area of the magnetic path. The thickness of the non-magnetic layer forms the necessary air gap in the magnetic path thereby permitting a thinner DLC coating to be applied to the region for adhesion optimization.

DESCRIPTION OF THE PREFERRED EMBODIMENTS

In accordance with the present invention, at least a portion of the wear surfaces, i.e., surfaces subject to repeated impact and/or sliding contact, of the valve member are coated with a layer of diamond-like carbon (DLC) stabilized by the presence of greater than 30 weight percent of a carbide-forming material selected from the group consisting of silicon, titanium, and tungsten. DLC, an amorphous carbon having a high degree of $sp^3$ bonding, as known in the art, is an extremely hard material that has a low coefficient of friction, excellent wear resistance, and a high degree of chemical inertness. Capability for DLC coating of various substrates is offered by a number of commercial facilities.

Figure 1:
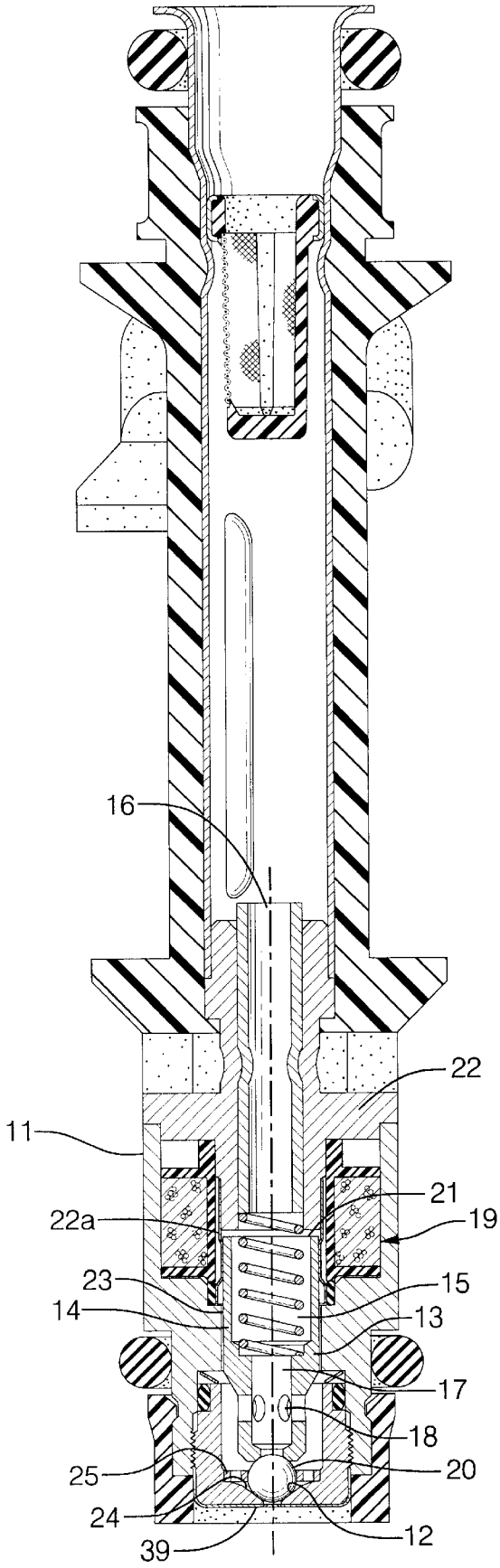
FIG. 1 is a side cross-sectional view of an embodiment of the fuel injector of the present invention wherein the moveable valve member includes a tubular core that defines an axial fuel inlet passage together with a substantially spherical valve element that provides a sealing interface with a valve seat. It is recognized that the features depicted in the drawings are not necessarily to scale.

In FIG. 1 is depicted one embodiment of the invention, a fuel injector 100 comprising a body 11, a valve seat 12 sealably connected to body 11, a moveable valve member 13 that includes a tubular core 14 that provides a fuel cavity 15 extending from an inlet 16 to an outlet 17 provided with circumferentially spaced fuel flow apertures 18. Core 14, which acts as an armature whose movement responds to energization of solenoid actuator 19, preferably is formed from steel, more preferably, magnetic stainless steel. Valve member 13 further comprises a valve outlet element 20 that preferably is formed from steel, more preferably, hardened stainless steel. Valve outlet element 20, which is substantially spherical and has a radius selected for engagement with valve seat 12, is preferably formed of hardened stainless steel and is connected to core 14 preferably by welding. The structure of fuel injector 100 is similar to that included in the fuel injector described in European Application EP 0781916 A1, whose disclosure is incorporated herein by reference.

Figure 2A:
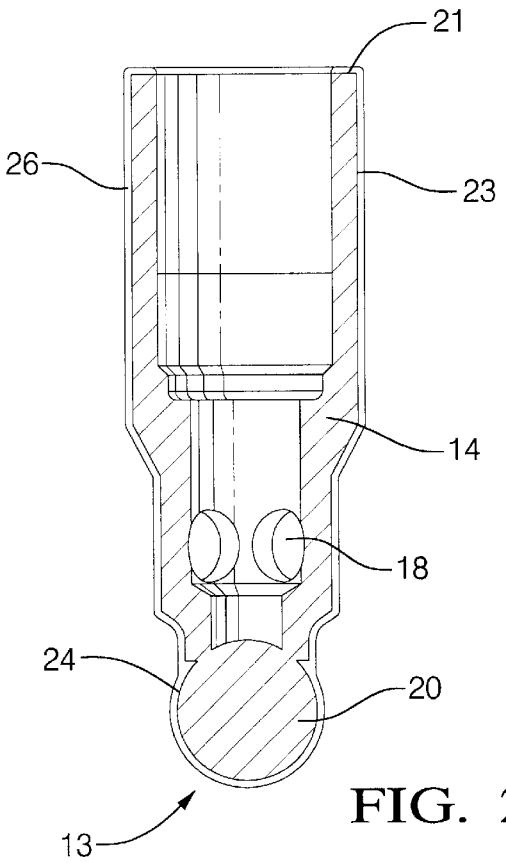
FIGS. 2A–D are cross-sectional side views depicting four embodiments of the valve member included in the fuel injector represented by FIG.1.

Core 14 has an inlet end external wear surface 21 that come into impact contact with a pole piece 22 and an annular external wear surface 23 that comes into sliding contact with a guide 22*a* connected to pole piece 22. Valve outlet element 20 has an external wear surface 24 that contacts valve seat 12 and a valve guide 25. In accordance with the present invention, at least a portion of wear surfaces 21, 23, and 24 are coated with a layer 26 of diamond-like carbon (DLC) stabilized by the presence of greater than 30 weight percent, preferably at least 40 weight percent, more preferably at least 50 weight percent, of a carbide-forming material selected from among titanium, tungsten, and, preferably, silicon. DLC layer 26 on wear surfaces 21, 23, and 24 of tubular core 14 and valve outlet element 20 included in valve member 13 is depicted in FIG. 2A. DLC layer 26 on each of wear surfaces 21, 23, and 24 has a thickness of up to about 6 $\mu$m, preferably up to about 3 $\mu$m. In an alternate embodiment described below, the DLC layer 26 on inlet end external wear surface 21 and annular wear surface 23 of core 14 has a thickness preferably of up to about 1 $\mu$m.

Where silicon is the carbide-forming material, DLC layer 26 is preferably formed by a plasma enhanced chemical vapor deposition (CVD) process on core and valve ball surfaces that have been etched by sputtering with an inert gas such as argon. Such processes are known in the art, for example, the previously mentioned U.S. Pat. No. 5,783,261. For a DLC layer 26 containing titanium or tungsten as the carbide-forming material, a physical vapor deposition (PVD) ion sputtering process that includes etching by sputtering with an inert gas, also known in the art, is the preferred method of deposition.

The amount of carbide-forming material, silicon for example, present in the DLC layer can be determined by Scanning Electron Microscopy with Energy dispersive X-ray Analysis (SEM-EDX), using, for example, a Hitachi S-2700 SEM instrument operated at 5 kV accelerating beam voltage.

Figure 2B:
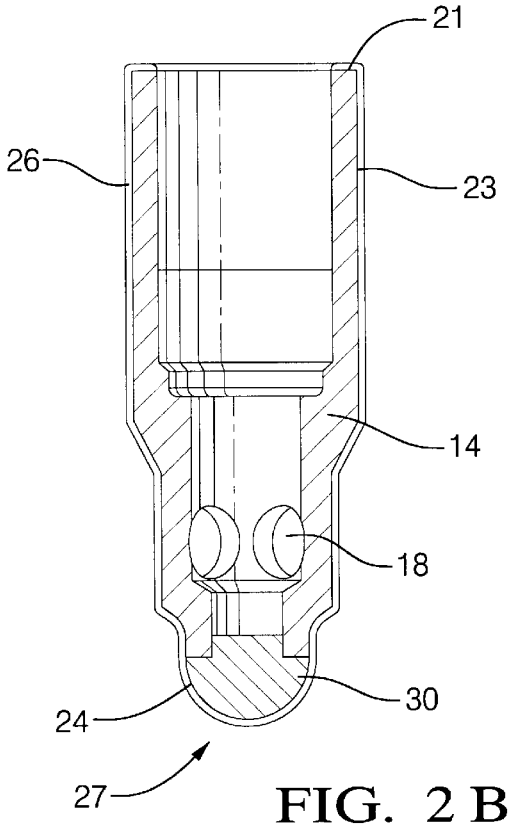
Figure 2C:
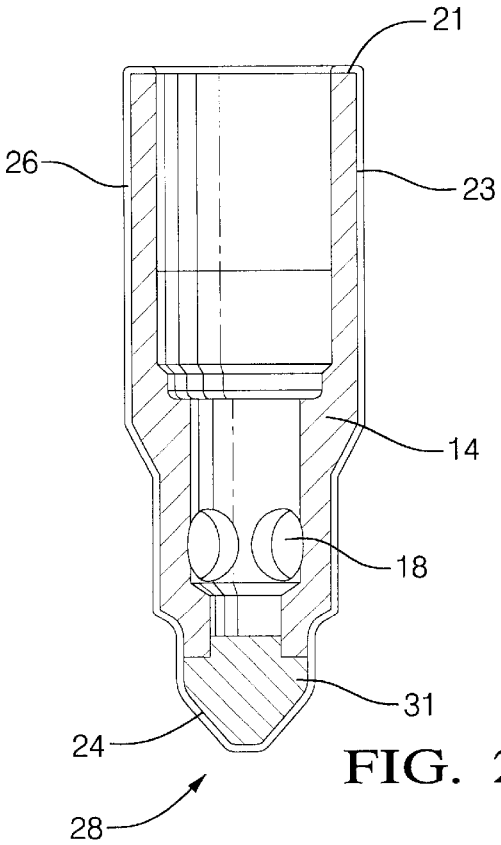
Figure 2D:
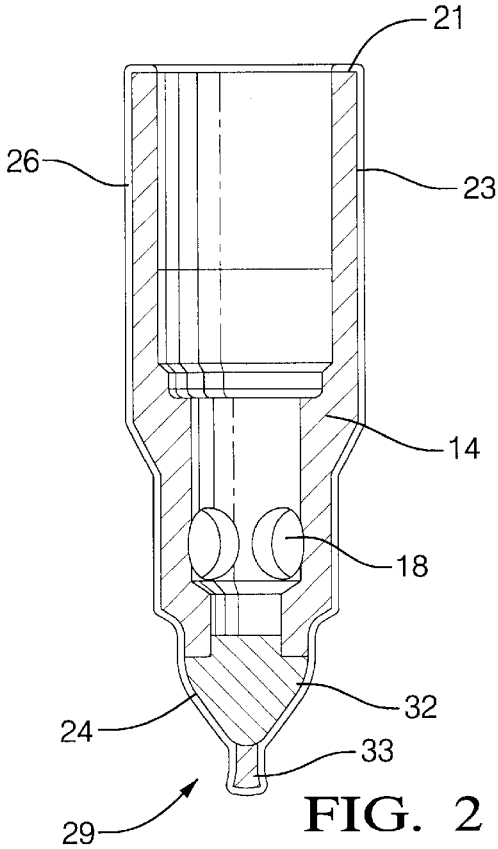
Figure 3A:
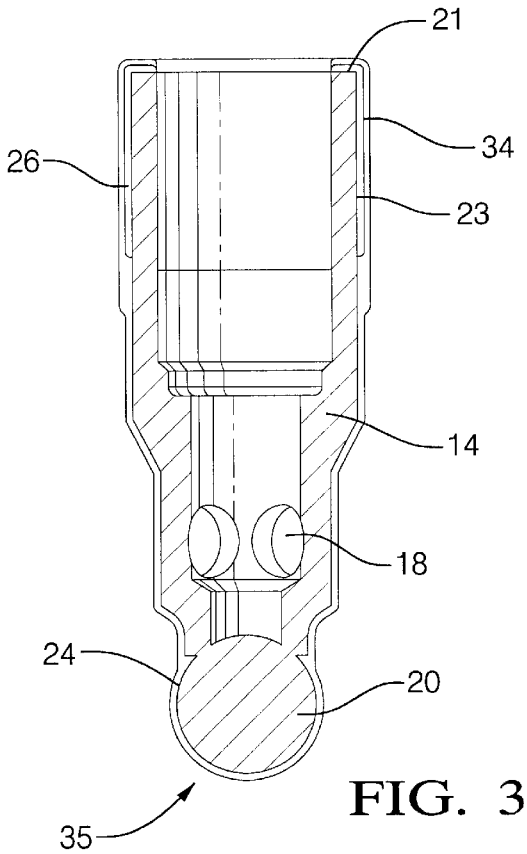
FIGS. 3A–D are cross-sectional side views depicting four further embodiments of the valve member included in the fuel injector represented by FIG.1.
Figure 3B:
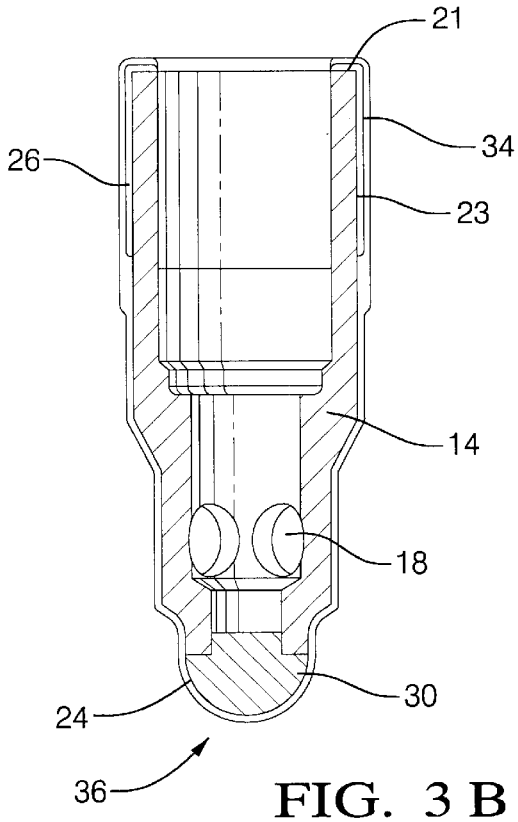
Figure 3C:
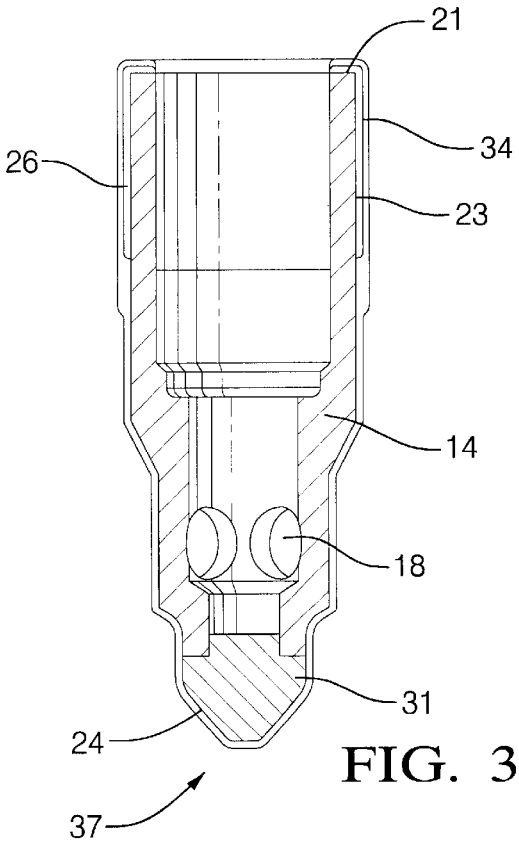
Figure 3D:
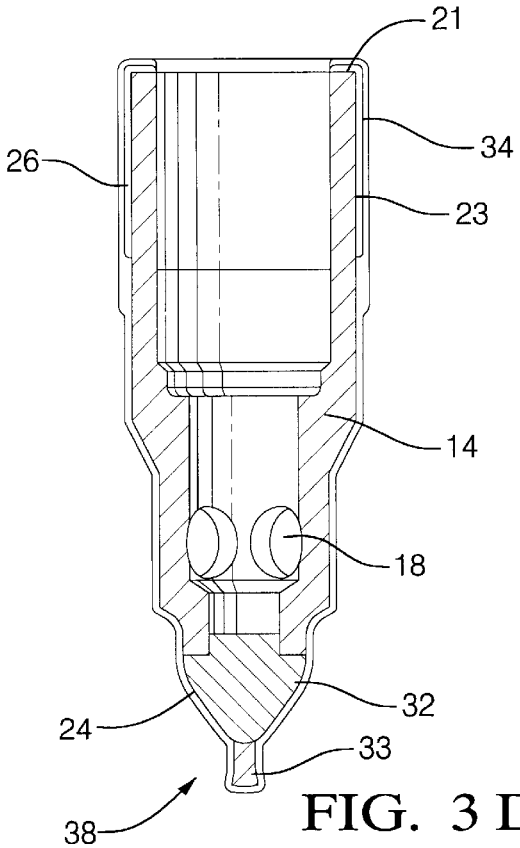

FIGS. 2B–D depict valve members 27, 28, and 29, which differ from valve member 13 primarily in the shape of the valve outlet element that contacts valve seat 12 and valve guide 25. Valve member 27 includes a valve outlet element 30 that is substantially hemispherical in shape, and valve outlet element 31 of valve member 28 is frusto-conical in shape. Valve outlet element 32 of valve member 29 is also frusto-conically shaped but further includes a needle 33 that serves a spray patterning and/or metering function. A director plate 39, as shown in FIG. 1, containing multiple sized orifices is commonly used to provide fuel metering for valve members 13, 27, and 28, and to help atomize the fuel spray.

FIGS. 3A–D depict valve members 35, 36, 37, and 38 in accordance with the present invention, which are similar to, respectively, valve members 13, 27, 28, and 29 depicted in FIGS. 2A–D, except for the inclusion of a non-magnetic metal layer 34 on wear surface 21 and annular wear surface 23 of core 14. The characteristics and mode of formation of DLC layers on the wear surfaces 21, 23, and 24 for moveable valve members 35, 36, 37, and 38, as well as for members 27,28, and 29, are the same as described above for valve member 13. Underlying non-magnetic metal layer 34 serves to maintain a minimum magnetic air gap between impact surface 21 and pole piece 22 and between wear surface 23 and guide 22*a*, enabling the use of a thinner DLC layer 26 in this region, preferably with a thickness of less than 1 $\mu$m, to prevent corrosion and reduce friction. Layer 34 preferably comprises chrome, for example, nodular thin dense chrome (NTDC), which can be deposited by electroplating to a thickness of up to about 6 $\mu$m, preferably up to about 4 $\mu$m.

As an alternative to using two separate processes to deposit non-magnetic metal layer 34 and DLC layer 26, an underlying layer 34 of smooth chromium or other non-magnetic metal, for example, titanium or tungsten, used for the air gap may be deposited along with DLC layer 26 in a single multistep CVD or PVD process, as known in the art.

In an evaluation with a corrosive fuel containing 85% ethanol and trace amounts of sulfuric acid, the DLC coating 26 on fuel injector 100 greatly exceeded a customer requirement of 250 million injection cycles without substantial damage to the fuel injector. Even after 1.1 billion injection cycles, virtually no wear was observed on the sliding and impact surfaces of fuel injector 100.

Figure 4:
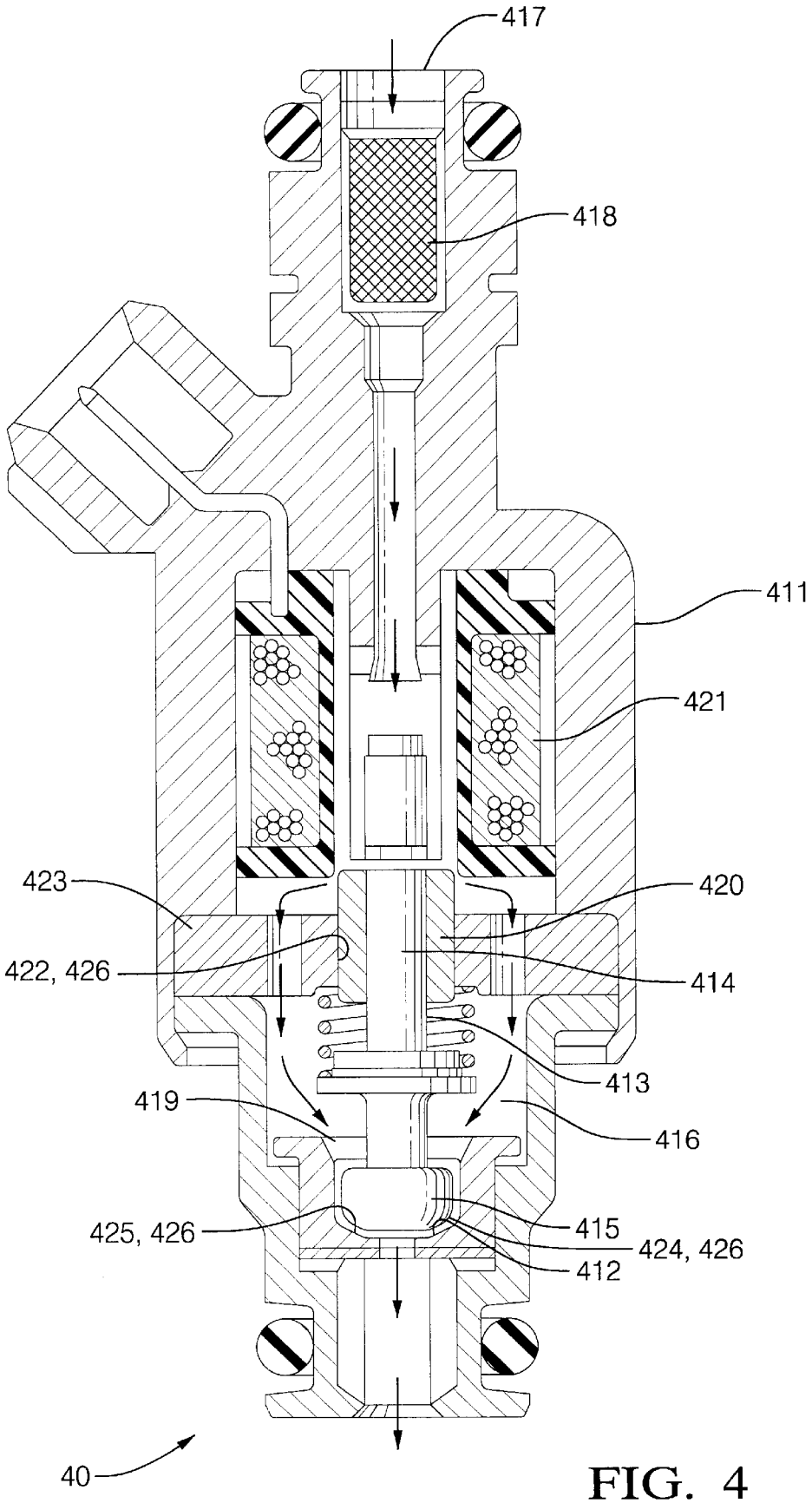
FIG. 4 is a side cross-sectional view of an embodiment of the fuel injector of the present invention wherein the moveable valve member includes a solid post connected to a hemispherical portion that provides a sealing interface with a valve seat.

Another embodiment of the present invention is depicted in FIG. 4. Fuel injector 40 comprises a body 411, a valve seat 412 sealably connected to body 411, a moveable valve member 413 that includes a solid post 414 terminating in a hemispherical valve outlet element 415 that provides a sealing interface with valve seat 412. Body 411 includes a fuel cavity 416 that extends from an inlet 417 provided with a filter 418 to an outlet 419. (The arrows indicate the flow of fuel through body 411). Post 414 and valve outlet element 415 are preferably formed from steel, more preferably, hardened stainless steel. Valve member 413 further comprises a magnetic core ring 420, which is connected to post 414, preferably by press fitting, and responds to energization of solenoid actuator 421.

Magnetic core ring 420 comprises a wear surface 422 where it comes in sliding contact with a spacer 423. Valve outlet element 415 comprises wear surfaces 424 and 425 where it comes in sliding and impact contact with valve seat 412. At least a portion of wear surfaces 422, 424, and 425 include, in accordance with the present invention, an applied layer 426 of diamond-like carbon (DLC) stabilized by inclusion of greater than 30 weight percent of a carbide-forming material selected from the group consisting of silicon, titanium, and tungsten.

Figure 5:
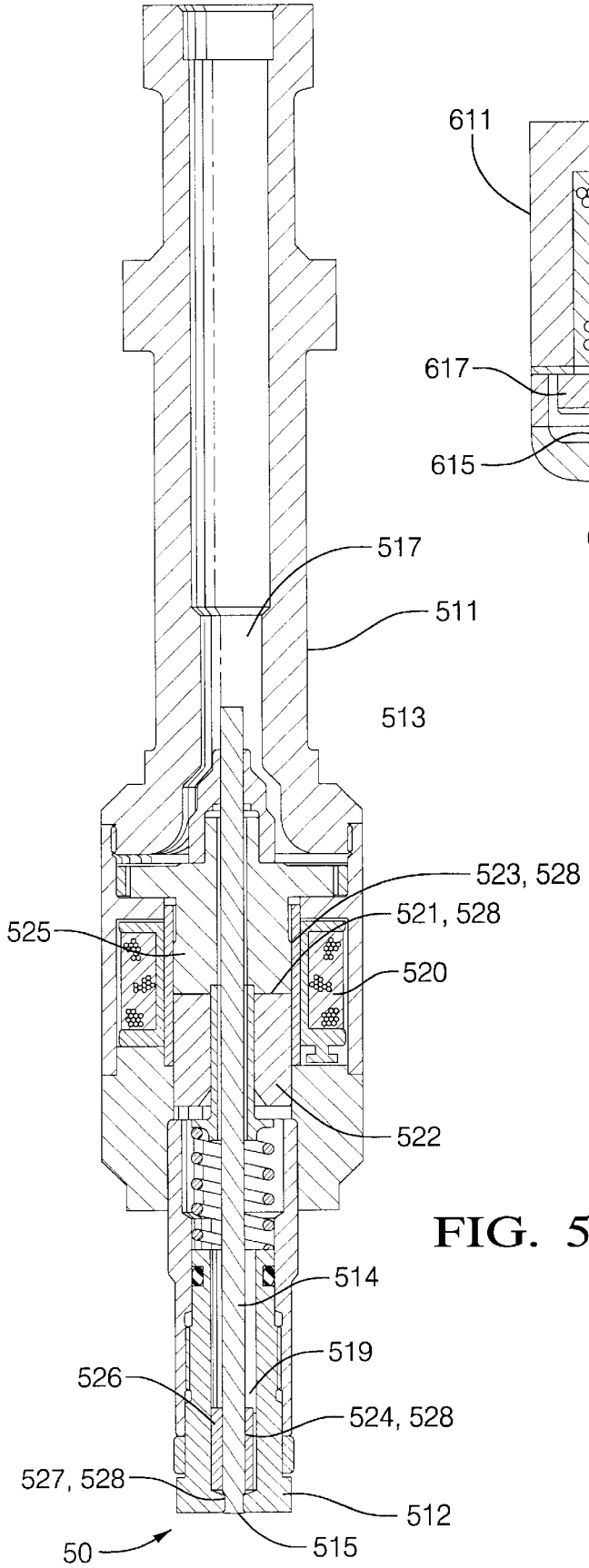
FIG. 5 is a side cross-sectional view of another embodiment of the fuel injector of the present invention wherein the valve element comprises a pintle having a needle that includes a sealing interface with a valve seat.

A fuel injector such as injector 100, depicted in FIG. 1, functions only for valving, metering typically being accomplished by director plate 39,which provides reduced sensitivity to fuel deposits. The present invention is also directed to needle-type injectors that use a pintle for both valving and metering. In FIG. 5 is depicted a fuel injector 50, which comprises a body 511, a valve seat 512 sealably connected to body 511, a moveable valve member 513 that comprises a pintle 514 terminating in a valve outlet element 515 that provides a sealing interface with valve seat 512. Body 511 includes a fuel cavity 517 that extends from an inlet 518 to an outlet 519.

In the operation of fuel injector 50, the energizing of valve member 513 by the solenoid actuator assembly 520 causes pintle 514 and valve outlet element 515 to move outwards from valve seat 512 to an open position. The co-action of valve outlet element 515 and valve seat 512 determines the fuel flow rate and spray pattern.

Valve member 513 comprises an impact wear surface 521, where it comes in impact contact with a pole piece 522, and a wear surface 523, where it is in sliding contact with upper guide 525. Pintle 514 includes a wear surface 524 where it is in sliding contact with lower guide 526. Valve outlet 515 comprises a wear surface 527 where it comes into sliding and impact contact with valve seat 512. In accordance with the present invention, at least a portion of wear surfaces 521, 523, 524, and 527 include an applied layer 528 of diamond-like carbon (DLC) stabilized by inclusion of greater than 30 weight percent of a carbide-forming material selected from the group consisting of silicon, titanium, and tungsten. Layer 528 has a thickness preferably of up to about 1 $\mu$m.

Figure 6:
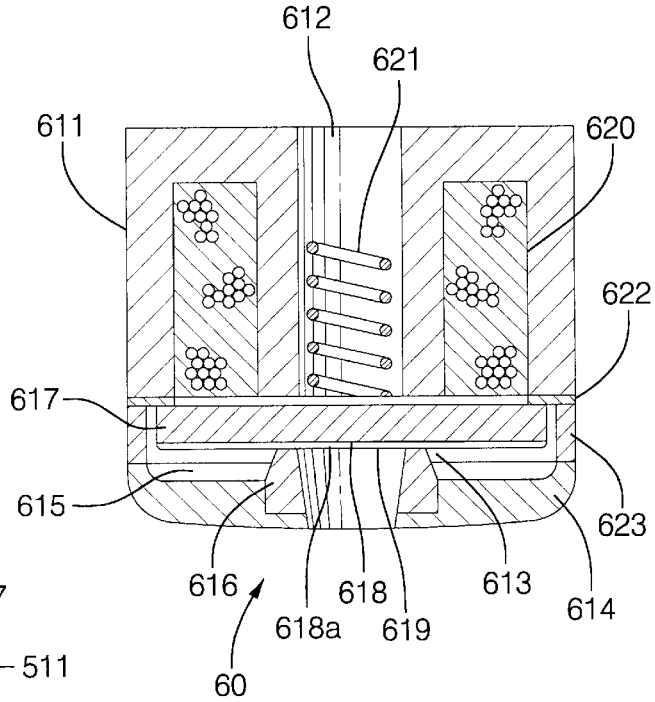
FIG. 6 is a side cross-sectional view of a further embodiment of the fuel injector valve of the present invention wherein the moveable valve element comprises a substantially flat disk that provides a sealing interface with a valve seat.

FIG. 6 schematically depicts a further embodiment of the present invention fuel injector 60, which comprises a body 611 having a fuel inlet 612 and a fuel outlet 613 and sealably connected to a base 614 that includes a fuel reservoir 615 and a valve seat 616. A disk-shaped valve member 617 includes, as a valve outlet element 618, a substantially flat surface 618*a* that provides a sealing interface with valve seat 616. Surface 618*a*, a portion of which is a wear surface of valve member 617, comprises, in accordance with the present invention, a layer 619 of diamond-like carbon (DLC) stabilized by inclusion of greater than 30 weight percent of a carbide-forming material selected from the group consisting of silicon, titanium, and tungsten is applied to surface 618*a*. Layer 619 has a thickness of preferably up to about 1 $\mu$m.

Body 611 includes a solenoid actuator 620 and a biasing spring 621. Valve member 617, which functions as an armature, comprises a magnetic material, for example, magnetic stainless steel. A flexible, non-magnetic shim 622 positioned between body 611 and a spacer ring 623 separates valve member 617 from solenoid actuator 620, which, when energized, causes valve member 617 to be urged upward and away from valve seat 616. On deactivation, biasing spring 621 causes valve member 617 to move downward and the DLC layer 619 on surface 618*a* to sealably contact valve seat 616, thereby shutting off the flow of fuel. Fuel injector 60 operates generally as described in U.S. Pat. No. 5,348,233, the disclosure of which is incorporated herein by reference.

The various embodiments of the fuel injector of the present invention exhibit improved wear and corrosion resistance in situations involving fuels contaminated with alcohols or water and find use in fuel-cell applications, where injector durability is a major problem.

In the embodiment shown, the valve outlet element is described as being spherical, hemispherical, frusto-conical, in the shape of a needle, or flat. However, it is understood that the valve outlet element can be alternately configured in any shape in order to achieve the desired fuel valving and/or metering by the injector.

The foregoing description of the several embodiments of the invention has been presented for the purpose of illustration and description and is not intended to be exhaustive or to limit the invention to the precise form disclosed. It will be apparent to those skilled in the art that the disclosed embodiments may be modified in light of the above teachings. The embodiments described are chosen to provide an illustration of principles of the invention and its practical application to enable one of ordinary skill in the art to utilize the invention in various embodiments and with modifications suited to a particular use. Therefore the foregoing description is to be considered exemplary rather than limiting, and the true scope of the invention is that described in the following claims.

We claim:

1. A fuel injector, comprising:

a body having a fuel inlet and a fuel outlet;

a valve seat connected to said body;

a valve member including a valve outlet element, at least one of said valve member and said valve outlet element having at least one wear surface, said wear surface being subject to mechanical wear, said valve outlet element configured for providing a sealing interface with said valve seat, said valve member being configured for controlling a flow of fuel from said fuel outlet;

a solenoid actuator assembly disposed within said body, said solenoid actuator assembly controlling movement of said valve member relative to said valve seat; and a layer of diamond-like carbon (DLC) disposed on said at least one wear surface, said layer of diamond-like carbon (DLC) including greater than 30 weight percent of a carbide-forming material.

2. The fuel injector of claim 1, wherein said carbide-forming material is selected from the group consisting essentially of silicon, titanium, and tungsten.

3. The fuel injector of claim 1, wherein said layer of diamond-like carbon (DLC) includes greater than 40 weight percent of a carbide-forming material.

4. The fuel injector of claim 1, wherein said layer of diamond-like carbon (DLC) includes greater than 50 weight percent of a carbide-forming material.

5. The fuel injector of claim 1, wherein said layer of diamond-like carbon (DLC) is applied by one of plasma enhanced chemical vapor deposition, ion sputtering, and physical vapor deposition.

6. The fuel injector of claim 1, wherein said layer of diamond-like carbon (DLC) has a thickness, said thickness being up to about 6 $\mu$m.

7. The fuel injector of claim 1, wherein said layer of diamond-like carbon (DLC) has a thickness, said thickness being up to about 3 $\mu$m.

8. The fuel injector of claim 1, wherein said layer of diamond-like carbon (DLC) has a thickness, said thickness being up to about 1 $\mu$m.

9. The fuel injector of claim 1, further comprising a layer of non-magnetic metal disposed between said at least one wear surface and said layer of diamond-like carbon (DLC).

10. The fuel injector of claim 9, wherein said layer of non-magnetic metal is selected from the group consisting essentially of chromium, titanium, and tungsten.

11. The fuel injector of claim 9, wherein said layer of non-magnetic metal is applied to said at least one wear surface by one of electroplating, plasma enhanced chemical vapor deposition, and physical vapor deposition.

12. The fuel injector of claim 9, wherein said layer of non-magnetic metal has a thickness, said thickness being up to about 6 $\mu$m.

13. The fuel injector of claim 9, wherein said layer of non-magnetic metal has a thickness, said thickness being up to about 4 $\mu$m.

14. The fuel injector of claim 9, wherein said layer of diamond like carbon has a thickness of less than 1 $\mu$m.

15. An electromagnetic fuel injector having improved wear characteristics, said fuel injector comprising:

a body having a fuel inlet and a fuel outlet;

a valve seat connected to said body;

a valve member having at least one wear surface, said valve member being positioned at said fuel outlet of said body for controlling fuel flow from said outlet, said valve member comprising a valve outlet element providing a sealing interface with said valve seat;

a solenoid actuator assembly disposed within said body, said solenoid actuator assembly controlling movement of said valve member relative to said valve seat; and a layer of diamond-like carbon (DLC) including greater than 30 weight percent of a carbide-forming material selected from the group consisting of silicon, titanium, and tungsten disposed on at least a portion of said at least one wear surface.

16. The fuel injector of claim 15 wherein said valve member is formed from stainless steel.

17. The fuel injector of claim 16 wherein said valve outlet element is formed from hardened stainless steel.

18. The fuel injector of claim 15 wherein said valve member further comprises a tubular core, said tubular core defining an axial fuel cavity, said core further having an inlet end wear surface and an annular wear surface.

19. The fuel injector of claim 18 wherein at least a portion of each said wear surface comprises a layer of diamond-like carbon (DLC) including greater than 30 weight percent of a carbide-forming material selected from the group consisting of silicon, titanium, and tungsten.

20. The fuel injector of claim 19 wherein said diamond-like carbon (DLC) layer on said annular wear surface of said tubular core has a thickness of up to about 1 $\mu$m.

21. The fuel injector of claim 19 wherein said tubular core comprises a layer of a non-magnetic metal underlying said layer of diamond-like carbon (DLC).

22. The fuel injector of claim 21 wherein said non-magnetic metal is selected from the group consisting of chromium, titanium, and tungsten.

23. The fuel injector of claim 22 wherein said non-magnetic metal is chrome.

24. The fuel injector of claim 21 wherein said layer of non-magnetic metal is applied to said annular wear surface of said tubular core by a process selected from the group consisting of electroplating, plasma enhanced chemical vapor deposition (CVD), and physical vapor deposition (PVD).

25. The fuel injector of claim 21 wherein said layer of non-magnetic metal has a thickness of up to about 6 $\mu$m.

26. The fuel injector of claim 21 wherein said layer of non-magnetic metal has a thickness of up to about 4 $\mu$m.

27. The fuel injector of claim 21, wherein said layer of diamond like carbon has a thickness of less than 1 $\mu$m.

28. The fuel injector of claim 18 wherein said tubular core further comprises fuel flow apertures defined in said tubular core.

29. The fuel injector of claim 15 further comprising a steel post extending within said housing.

30. The fuel injector of claim 15 wherein said diamond-like carbon (DLC) layer includes at least 40 weight percent of said carbide-forming material.

31. The fuel injector of claim 15 wherein said diamond-like carbon (DLC) layer includes at least 50 weight percent of said carbide-forming material.

32. The fuel injector of claim 15 wherein said carbide-forming material comprises silicon.

33. The fuel injector of claim 15 wherein said diamond-like carbon (DLC) layer is applied to said at least one wear surface by plasma enhanced chemical vapor deposition (CVD).

34. The fuel injector of claim 15 wherein said diamond-like carbon (DLC) layer is applied by ion sputtering.

35. The fuel injector of claim 15 wherein said diamond-like carbon (DLC) layer is applied by physical vapor deposition (PVD).

36. The fuel injector of claim 15 wherein said diamond-like carbon (DLC) layer has a thickness of up to about 6 $\mu$m.

37. The fuel injector of claim 15 wherein said diamond-like carbon (DLC) layer has a thickness of up to about 3 $\mu$m.

38. The fuel injector of claim 15 wherein said valve outlet element providing a sealing interface with said valve seat is substantially spherical and has a radius selected for engagement with said valve seat.

39. The fuel injector of claim 15 wherein said valve outlet element providing a sealing interface with said valve seat is substantially hemispherical and has a radius selected for engagement with said valve seat.

40. The fuel injector of claim 15 wherein said valve outlet element providing a sealing interface with said valve seat comprises a frusto-conical wear surface.

41. The fuel injector of claim 15 wherein said valve outlet element providing a sealing interface with said valve seat comprises a needle.

42. The fuel injector of claim 41 wherein a layer of diamond-like carbon (DLC) stabilized by inclusion of greater than 30 weight percent of a carbide-forming material selected from the group consisting of silicon, titanium, and tungsten is disposed on said needle, and said layer has a thickness of up to about 1 $\mu$m.

43. The fuel injector of claim 15 wherein said valve outlet element providing a sealing interface with said valve seat comprises a disk-shaped valve member having a substantially flat wear surface as the valve outlet element.

44. The fuel injector of claim 43 wherein a layer of diamond-like carbon (DLC) includes greater than 30 weight percent of a carbide-forming material selected from the group consisting of silicon, titanium, and tungsten is disposed on said flat wear surface.

45. The fuel injector of claim 43 wherein said disk-shaped valve member comprises magnetic stainless steel.

46. The fuel injector of claim 43 wherein said layer has a thickness of up to about 1 $\mu$m.

* * * * *